US008475256B2

(12) United States Patent
Bryant et al.

(10) Patent No.: US 8,475,256 B2
(45) **Date of Patent: *Jul. 2, 2013**

(54) GAMING MACHINE WITH BUY FEATURE GAMES

(75) Inventors: Natalie Bryant, Lane Cove (AU); Nicholas Luke Bennett, Lane Cove (AU)

(73) Assignee: Aristocrat Technologies Australia Pty Ltd (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/015,752

(22) Filed: Jan. 28, 2011

(65) Prior Publication Data

US 2011/0118005 A1 May 19, 2011

Related U.S. Application Data

(63) Continuation of application No. 12/018,605, filed on Jan. 23, 2008, now Pat. No. 8,038,524, which is a continuation of application No. 10/070,266, filed on Jul. 19, 2002, now abandoned.

(30) Foreign Application Priority Data

Aug. 25, 1999 (AU) ..... PQ 2428
Aug. 23, 2000 (WO) ..... PCT/AU00/00997

(51) Int. Cl.
*A63F 9/24* (2006.01)

(52) U.S. Cl.
USPC ..... 463/16; 463/20

(58) Field of Classification Search
USPC ..... 463/16, 20
See application file for complete search history.

(56) References Cited

U.S. PATENT DOCUMENTS

| | | | |
|---|---|---|---|
| 1,681,683 | A | 8/1928 | Ramer |
| 3,580,581 | A | 5/1971 | Raven |
| 4,306,768 | A | 12/1981 | Egging |
| 4,448,419 | A | 5/1984 | Telnaes |
| 4,686,521 | A | 8/1987 | Beaven et al. |
| 4,711,451 | A | 12/1987 | Pajak et al. |
| 4,718,672 | A | 1/1988 | Okada |
| 4,743,022 | A | 5/1988 | Wood |

(Continued)

FOREIGN PATENT DOCUMENTS

| | | |
|---|---|---|
| AU | 17509/88 | 12/1988 |
| AU | 70382 | 8/1995 |

(Continued)

OTHER PUBLICATIONS

Request for Ex-Parte Re-Exam by Kevin T. Cuenot, Esq. of USPN 8,038,524, dated Oct. 18, 2011.

(Continued)

*Primary Examiner* — Corbett B Coburn
(74) *Attorney, Agent, or Firm* — McAndrews, Held & Malloy, Ltd.

(57) ABSTRACT

A gaming machine including a display. The display includes a plurality of display positions for displaying combinations of symbols. A controller controls operation of the machine. The controller includes a processor for processing data and displaying selected data on the display. A selector is operable by the player of the machine for enabling the player to select at least one feature which can be added to a base game played on the machine.

24 Claims, 9 Drawing Sheets

U.S. PATENT DOCUMENTS 4,743,024 A 5/1988 Helm et al.
4,756,531 A 7/1988 DiRe et al.
4,826,169 A 5/1989 Bessho et al.
4,838,552 A 6/1989 Haglwara
4,856,787 A 8/1989 Itkis
4,871,171 A 10/1989 Rivero
5,019,973 A 5/1991 Wilcox et al.
5,042,818 A 8/1991 Weingardt
5,088,737 A 2/1992 Frank et al.
5,150,907 A 9/1992 Desmarais et al.
5,228,693 A 7/1993 Howard
5,283,560 A 2/1994 Bartlett
5,342,047 A 8/1994 Heidel
5,344,145 A 9/1994 Chadwick et al.
5,351,966 A 10/1994 Tohyama et al.
5,354,069 A 10/1994 Guttman et al.
5,356,140 A 10/1994 Dabrowski et al.
5,375,830 A 12/1994 Takemoto et al.
5,380,007 A 1/1995 Travis et al.
5,393,057 A 2/1995 Marnell, II
5,395,111 A 3/1995 Inoue
5,462,277 A 10/1995 Takemoto
5,580,053 A 12/1996 Crouch
5,588,650 A 12/1996 Eman et al.
5,596,693 A 1/1997 Needle et al.
5,630,753 A 5/1997 Fuchs
5,664,999 A 9/1997 Kurihara
5,673,401 A 9/1997 Volk et al.
5,704,835 A 1/1998 Dietz, II
5,732,950 A 3/1998 Moody
5,752,881 A 5/1998 Inoue
5,788,573 A 8/1998 Baerlocher et al.
5,803,809 A 9/1998 Yoseloff
5,807,172 A 9/1998 Piechowiak
5,807,178 A 9/1998 Todokoro
5,816,915 A 10/1998 Kadlic
5,816,916 A 10/1998 Moody
5,823,873 A 10/1998 Moody
5,830,063 A * 11/1998 Byrne ..... 463/18
5,836,586 A 11/1998 Marks et al.
5,848,932 A 12/1998 Adams
5,853,325 A 12/1998 Kadlic
5,867,166 A 2/1999 Myhrvold et al.
5,868,619 A * 2/1999 Wood et al. ..... 463/13
5,870,097 A 2/1999 Snyder et al.
5,880,709 A 3/1999 Itai et al.
5,890,962 A 4/1999 Takemoto
5,902,184 A 5/1999 Bennett
5,935,002 A 8/1999 Falciglia
5,947,820 A 9/1999 Morro et al.
5,947,821 A 9/1999 Stone
5,951,397 A 9/1999 Dickinson
5,971,849 A 10/1999 Falciglia
5,980,384 A 11/1999 Barrie
6,004,208 A 12/1999 Takemoto et al.
6,007,066 A 12/1999 Moody
6,017,032 A * 1/2000 Grippo et al. ..... 273/138.1
6,033,307 A 3/2000 Vancura
6,050,568 A 4/2000 Hachquet
6,050,895 A 4/2000 Luciano, Jr. et al.
6,059,289 A 5/2000 Vancura
6,062,978 A 5/2000 Martino et al.
6,068,552 A 5/2000 Walker
6,089,977 A 7/2000 Bennett
6,089,978 A 7/2000 Adams
6,098,985 A 8/2000 Moody
6,106,393 A 8/2000 Sunaga et al.
6,110,043 A 8/2000 Olsen
6,113,102 A 9/2000 Marks et al.
6,118,427 A 9/2000 Buxton et al.
6,120,031 A 9/2000 Adams
6,120,378 A 9/2000 Moody et al.
6,123,333 A 9/2000 McGinnis, Sr. et al.
6,126,542 A 10/2000 Fier
6,135,883 A 10/2000 Hachquet
6,135,884 A 10/2000 Hedrick et al.
6,149,156 A 11/2000 Feola
6,159,095 A 12/2000 Frohm et al.
6,159,097 A 12/2000 Gura
6,159,098 A 12/2000 Slomiany et al.
6,162,121 A 12/2000 Morro et al.
6,173,955 B1 1/2001 Perrie et al.
6,190,254 B1 2/2001 Bennett
6,193,606 B1 2/2001 Walker
6,203,428 B1 3/2001 Giobbi et al.
6,203,429 B1 3/2001 Demar et al.
6,213,875 B1 4/2001 Suzuki
6,234,897 B1 5/2001 Frohm et al.
6,251,013 B1 6/2001 Bennett
6,261,177 B1 7/2001 Bennett
6,270,405 B1 8/2001 Ferguson
6,312,334 B1 11/2001 Yoseloff
6,315,660 B1 11/2001 DeMar et al.
6,317,128 B1 11/2001 Harrison et al.
6,322,309 B1 11/2001 Thomas et al.
6,354,939 B1 3/2002 Morita et al.
6,368,216 B1 4/2002 Hedrick et al.
6,380,956 B1 4/2002 Yee et al.
6,443,837 B1 9/2002 Jaffe et al.
6,454,266 B1 9/2002 Breeding et al.
6,482,089 B2 11/2002 DeMar et al.
6,505,117 B1 1/2003 Ratert et al.
6,506,116 B1 1/2003 Sunaga et al.
6,508,707 B2 1/2003 DeMar et al.
6,520,855 B2 2/2003 DeMar et al.
6,529,626 B1 3/2003 Watanabe et al.
6,533,660 B2 3/2003 Seelig et al.
6,575,829 B2 6/2003 Coleman et al.
6,582,305 B1 6/2003 Carter
6,587,118 B1 7/2003 Yoneda
6,840,858 B2 1/2005 Adams
7,115,033 B1 10/2006 Timperley
7,419,429 B2 * 9/2008 Taylor ..... 463/25
7,618,319 B2 11/2009 Casey et al.
7,846,018 B2 12/2010 Baerlocher
2002/0155873 A1 10/2002 Berman
2005/0124404 A1 6/2005 Nicely
2005/0215311 A1 9/2005 Hornik et al.
2006/0079321 A1 4/2006 Walker et al.
2007/0060240 A1 3/2007 White
2009/0117961 A1 5/2009 Bennett et al.
2009/0239605 A1 9/2009 Ekisheva et al.
2010/0124989 A1 5/2010 Englman et al.

FOREIGN PATENT DOCUMENTS

AU 708104 10/1997
AU 199745197 1/1998
AU 711501 10/1999
AU 199942504 12/1999
AU 199943488 3/2000
AU 721968 B2 7/2000
AU 771847 4/2004
DE 2938307 9/1981
DE 4426658 1/1996
EP 0368628 5/1990
GB 1535095 12/1978
GB 2056737 3/1981
GB 2072395 9/1981
GB 2098778 11/1982
GB 2137392 10/1984
GB 2222712 3/1990
GB 2229371 9/1990
GB 2233241 9/1991
GB 2252705 12/1992
GB 2271262 6/1994
JP 04114676 4/1992
WO 9303464 2/1993
WO 9608799 3/1996
WO 9731344 8/1997
WO 9732285 9/1997
WO 9900164 1/1999
WO 9964997 12/1999
WO 0032286 6/2000
WO 0115055 A1 3/2001

OTHER PUBLICATIONS

Top Cat Publication, Industry Trade Magazine, "Strictly Slots,", Apr. 1999.

Fey, Marshall, "Slot Machines a Pictorial History of the First 100 Years", 1983-1997, Liberty Belle Books, selected pages supplied by the Examiner as cited in U.S. Appl. No. 10/001,433.

Amended Particulars of Invalidity, filed on behalf of the Respondent/Cross-Claimant by Benjamin Lee Miller, Blake Dawson, in the Federal Circuit Court of Australia, New South Wales District Registry, General Division, between Aristocrat Technologies Australia Pty Ltd., ACN 001 660 715, Applicant/Cross-Respondent and IGT (Australia) Pty Ltd., ACN 002 904 690, Respondent/Cross-Claimant, dated Mar. 3, 2011.

Examiner's first report corresponding to AU Patent Application No. 2011200453, Mar. 22, 2012, 3 pages.

Lora Croft Tomb Raider Web Page,—http://shopping.yahoo.com/shop?d=zygm&Id=19510086648,clink=dmks/Tomb_Raider, p. 1, (as early as Nov. 1996).

* cited by examiner

GAMING MACHINE WITH BUY FEATURE GAMES

RELATED APPLICATIONS

This application claims priority to, and is a continuation of, U.S. application Ser. No. 12/018,605, having a filing date of Jan. 23, 2008 and which issued on Oct. 18, 2011 as U.S. Pat. No. 8,038,524, which claims priority to, and is a continuation of, U.S. patent application Ser. No. 10/070,266, now abandoned, having a filing date of Jul. 19, 2002, which claims priority to International Application PCT/AU00/00997, filed on Aug. 23, 2000, which in turn claims priority to Australian Application No. PQ 2428, filed on Aug. 25, 1999, each of which is also incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a gaming machine. More particularly, the invention relates to a gaming machine of the type known as a slot machine or a fruit machine. Certain types of these machines have a series of rotatable reels, each of which displays a series of symbols or a video simulation of such a mechanism while other types of machines are arranged to play video simulations of card games or other types of wagering games, such as bingo or keno. The invention has particular application to an improved game played on such a machine.

Players regularly playing gaming machines need to have their interests maintained. Therefore, it is necessary for manufacturers of these machines to develop inventive game features which add interest to the games provided on such machines in order to keep the players entertained and willing to continue to play the games.

There is a continuous trade-off between what the players of the machines want and what the operators of the machines want from the machines. Naturally, operators want the players to stake more money per game so that the overall turnover is higher. Conversely, players will not do this unless they feel that they are getting more for the extra money that they are betting.

Further, as the range of machines and games increases, it is becoming increasingly important to offer more options to the players. The more options that are available in one machine, the easier it is to maintain the player's interest and the easier it is for players to be able to gain access to a machine that will offer them exactly the game that they want.

To date, most types of video gaming machines which are available to players offer limited options. At best, a range of bet sizes and paylines upon which the players can bet are offered. Certain machines also offer a double-up option available after a win while other machines have various ranges of paytables particularly for higher bets.

BRIEF SUMMARY OF THE INVENTION

According to the invention there is provided a gaming machine which includes:

a display means including a plurality of display positions for displaying combinations of symbols;

a control means for controlling operation of the machine, the control means including a processing means for processing data and displaying selected data on the display means; and a selecting means operable by a player of the machine for enabling the player to select at least one feature which can be added to a base game played on the machine.

The base game may have no features at all. For example, in the case of a video simulation of a spinning reel game, there would be no scatter symbol or substitute symbol or feature triggered by the occurrence of a predetermined or random event. Instead, by means of the selecting means, the player may be able to select at least one and, preferably, a range of features that can be added to the base game to tailor the base game to the player's requirements. Various features may be offered. For example, certain symbols may be selected to pay as scatter symbols or substitute symbols as well as or in addition to the standard pays. Other examples include additional types of pays, for example, right to left as well as the basic left to right pay or bonus features such as free games, bonus pays, etc which are triggered by certain combinations.

Certain features may be offered as no-cost features which are selected by the player by means of the selecting means. Other features may have a cost associated therewith a player having to stake additional credit to obtain the feature or eligibility to the feature. If desired, the bet to obtain one or more features may be independent of the type or size of bet made on the base game. Thus, it is not necessary for the maximum bet to be placed on the base game before access can be gained to the range of features. In addition, the cost for the various features may differ depending on the type of feature or range of features selected.

In one embodiment of the invention, where only one additional feature or a range of the same type of feature is offered, the additional credit staked by the player may be a multiple of a base bet wagered by the player. Different multiples of the base bet may purchase different features of that type. For example, a bet X2 feature may purchase two free spins, a bet X3 feature may purchase four free spins and bet X4 feature may purchase six free spins.

The selecting means may include a plurality of selectors, such as buttons on the midtrim, operable by the player to select the feature required before making the base bet. One of the buttons may be used by the player when only the base bet is to be staked.

Only one feature, if any, at a time may be selectable by the player by means of the selectors. For example, a standard bet with no additional feature may be wagered, or a bet with only one type of feature may be wagered.

The additional credit staked may only provide eligibility to a benefit provided by that feature, there being no guarantee that the feature will eventuate merely by having staked the additional credit. Hence, the player will not necessarily see a direct result of the extra stake for every game played. For example, a predetermined combination may need to appear to trigger the special feature (e.g. free spins) or to pay a bonus prize (egg a right to left pay).

In another embodiment of the invention, the additional credit staked may be a fixed amount multiplied by a bet wagered per line (for a spinning reel game) or per draw (for a card game).

The feature for which the additional credit is staked may be triggered independently of the base game. In other words, a random selection is made by the control means as to whether or not to trigger the feature completely independently of the base game.

Further, the gaming machine may be a multi-game machine having various games. Then, the appropriate game may initially be chosen and, thereafter, the required feature or features for the game may be selected by the player.

The selecting means may include dedicated keys or buttons on a keypad of the gaming machine and/or a touch or interactive screen of the display mean for enabling the features and/or games to be selected.

BRIEF DESCRIPTION OF SEVERAL VIEWS OF THE DRAWINGS

The invention is now described by way of example with reference to the accompanying diagrammatic drawings in which.

DETAILED DESCRIPTION OF THE DRAWINGS

Figure 1:
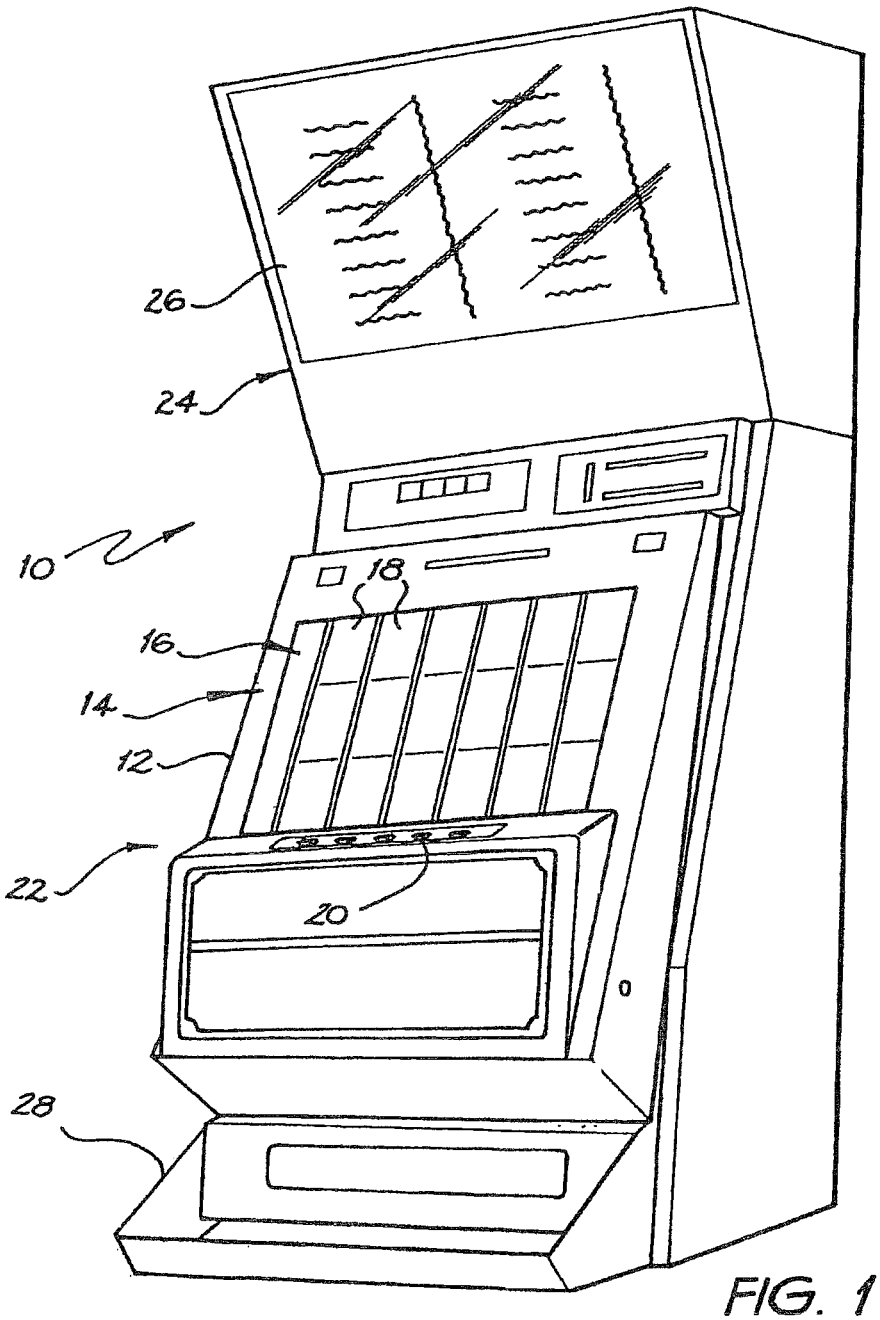
FIG. 1 shows a three dimensional view a gaming machine.

In FIG. 1, reference numeral 10 generally designates a gaming machine, including a game, in accordance with the invention. The machine 10 includes a gaming console 12 having a video display unit 14. The video display unit includes a screen 16 on which reels 18 are simulated. A keypad 20, which is shown in greater detail in FIG. 3 of the drawings, is mounted on a midtrim 22 of the machine 10.

The machine includes a topbox 24 on which a paytable 26 is arranged.

Figure 2:
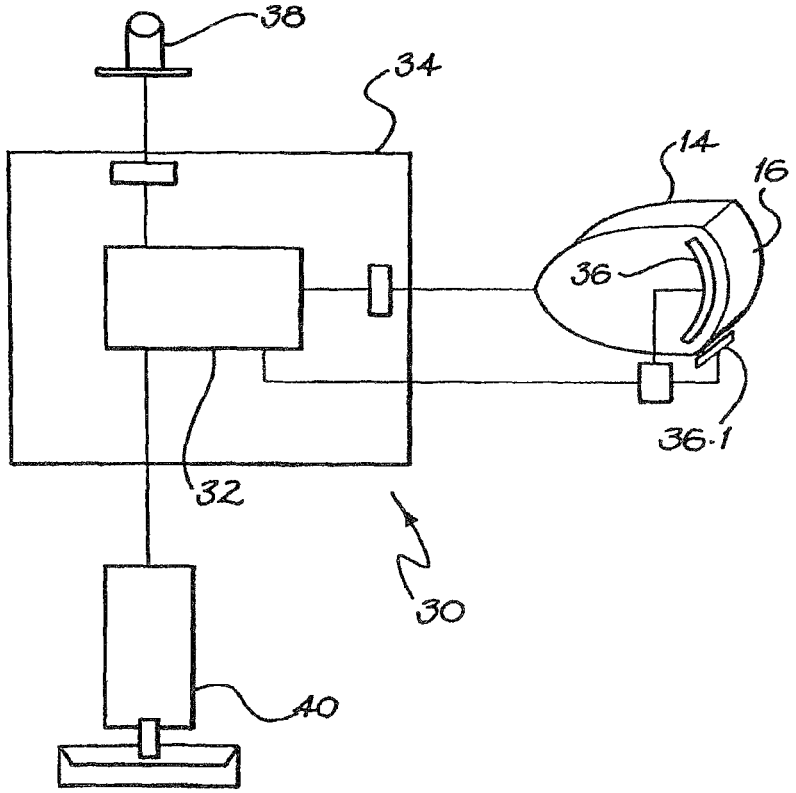
FIG. 2 shows a block diagram of a control means of the gaming machine.

Referring now to FIG. 2 of the drawings, a control means 30 of the machine 10 is illustrated. A program which implements the game and user interface is run on a processor 32 of the control means 30. The processor 32 . . . forms part of a controller 34 which drives the screen 16 of the video display unit 14. The processor 32 receives input signals from a first group of sensors 36.1 which are responsive to keys of the keypad 20. A second group of sensors 36.2 are touch sensors associated with the screen 16 of the video display unit 14.

The controller 34 also receives input pulses from a mechanism 38 indicating that a player has provided sufficient credit to begin playing. The mechanism 38 may be a coin input chute, a bill collector, a credit card reader, any other type of validation device, or a combination thereof.

The controller 34 also controls a payout mechanism 40 which, for example, may be a coin hopper for feeding coins to a coin tray 28 of the machine 10.

With the game of the gaming machine 10, a player playing the machine 10 has the option to make a bet that is a multiple of a base bet to buy an additional feature to the game. The additional bet need not be a multiple of the specified maximum bet of the machine 10. Thus, the player is allowed to, for example, double or treble their initial bet to be eligible for an additional game feature. In this way, even players who bet a single credit on one line (on a multi-line game), are eligible to buy features, by doubling or trebling their bets.

The extra bet that the player is required to make does not make any change to the game the player has bought other than to introduce eligibility to the feature. In other words, no additional pay lines are bought or linear increases made to the pay table as the extra bet is a dedicated bet towards the feature.

Figure 3:
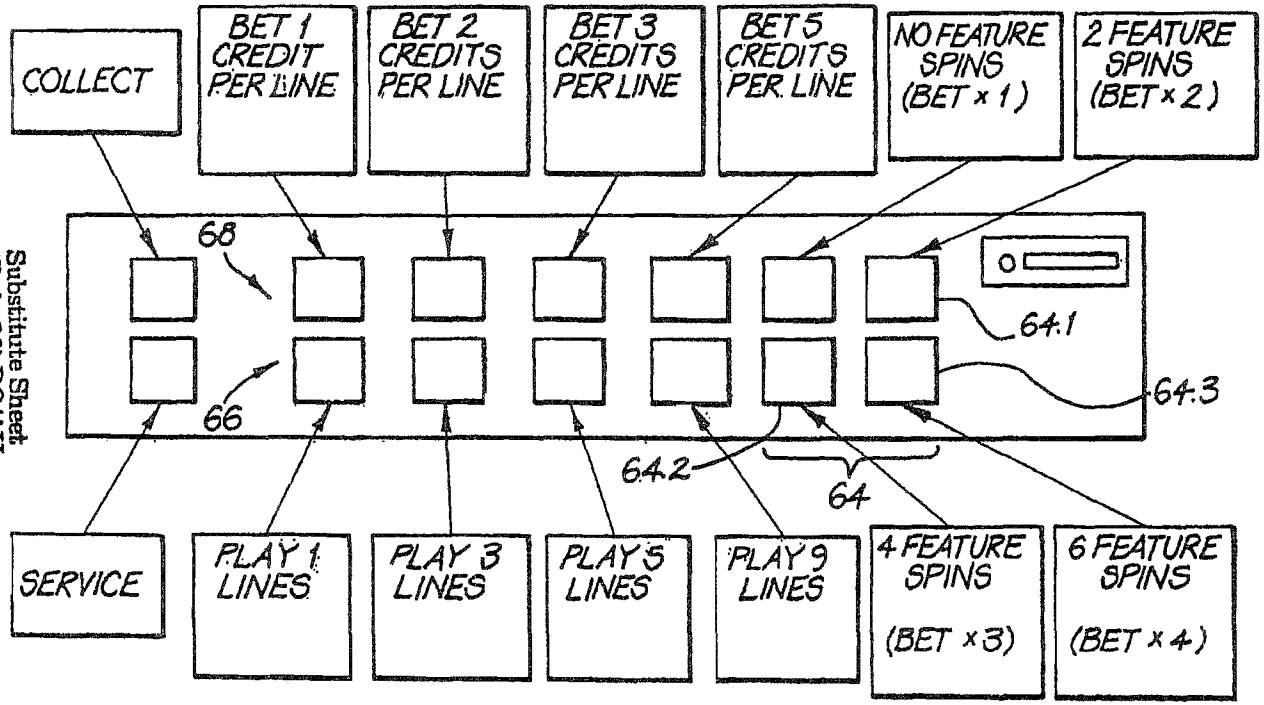
FIG. 3 shows a schematic plan representation of one embodiment of a keypad of the gaming machine.

Referring now to FIG. 3 of the drawings a modified keypad 20 for the machine is shown. Instead of, or in addition, to the touch screen facility in the screen 16 of the video display unit 14 of the machine 10, dedicated buttons 64 are provided on the keypad 20.

The keypad 20 has a conventional array of buttons 66 for enabling the player to select the number of lines of the machine on which to achieve a payout as well as a conventional array of buttons 68 for enabling the player to select the number of credits to be bet per line.

A "base bet" is represented by the buttons 68 labelled "Bet x credits per line" and the buttons 66 labelled "Play x lines". The feature of the game is that if a player stakes double the base bet by means of button 64.1 then, whenever a specified combination of symbols is spun up, certain reel positions will be held while the rest of the reels are spun again twice for free. For triple the base bet (button 64.2) the same combination would result in four free spins and for quadruple the base bet (button 64.3) there would be six free spins. Thus, if the player is betting two credits per line on five lines then the base bet will be ten credits. If the player chooses to buy access to the four free spins feature by selecting the "four feature spins (bet x 3)" button 64.2 then a game will cost the player thirty credits. The payline prizes will still only be multiplied by the player's bet per line of two credits, and prize combinations will still only apply on the five lines that have been bought. However, the additional feature of a specified combination of symbols awarding four re-spins of some of the reels will apply. Accordingly, it will be noted that only the base bet or the base bet plus the additional credit for one type of feature may be wagered at any one time. Also, the mere wagering of the additional credit does not guarantee that the feature will occur. The wagering of the additional credit only provides eligibility for the applicable feature.

It will be appreciated that various other options could be provided by means of the appropriate number of buttons 64 on the keypad 20.

In this embodiment, other examples which are possible are, inter alia, the additional feature may be the purchase of a certain combination which, if obtained, will commence a free game series. Instead, an additional feature trigger symbol may be purchased so that, in addition to an original trigger symbol, the additional trigger symbol also provides a free spin feature. Yet further, a right-to-left payout feature, in addition to the more conventional left-to-right payout can be bought.

Figure 4:
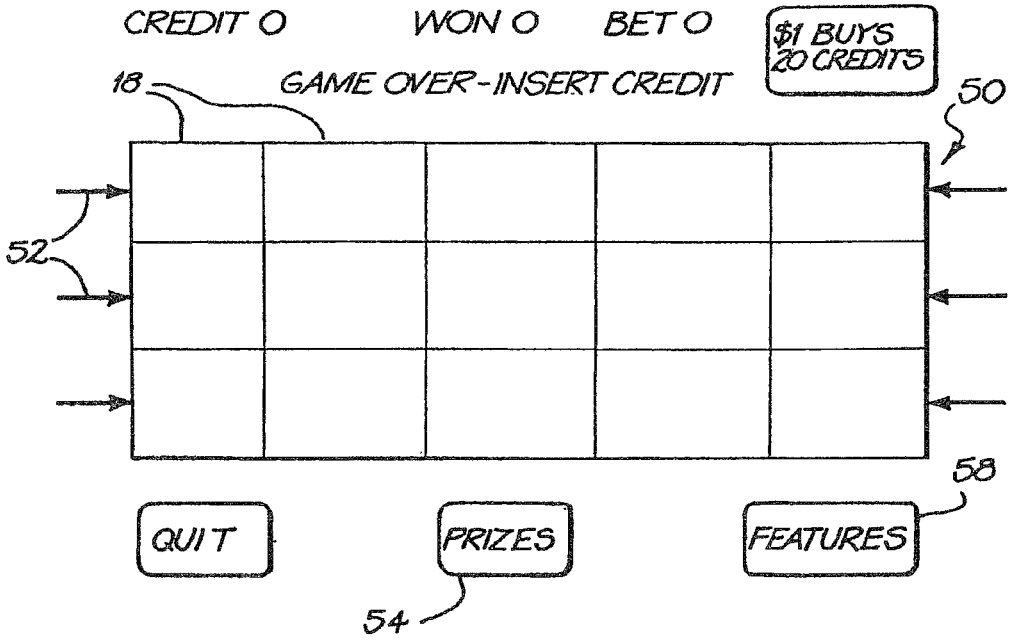
FIG. 4 shows a schematic representation of a first screen of the gaming machine.
Figure 5:
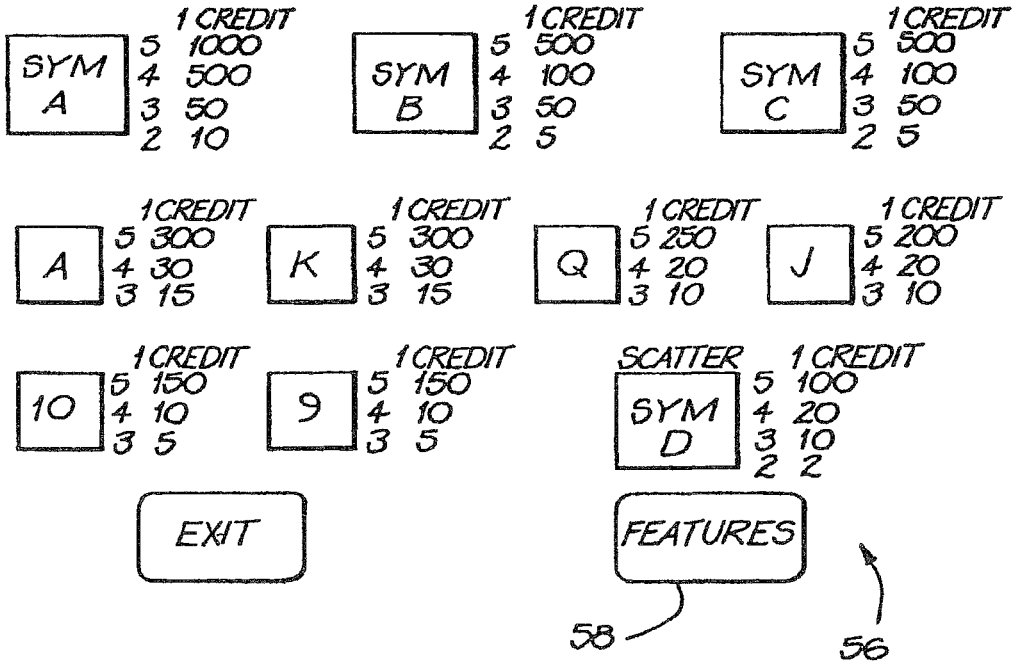
FIG. 5 shows a schematic representation of a second screen of the gaming machine.
Figure 6:
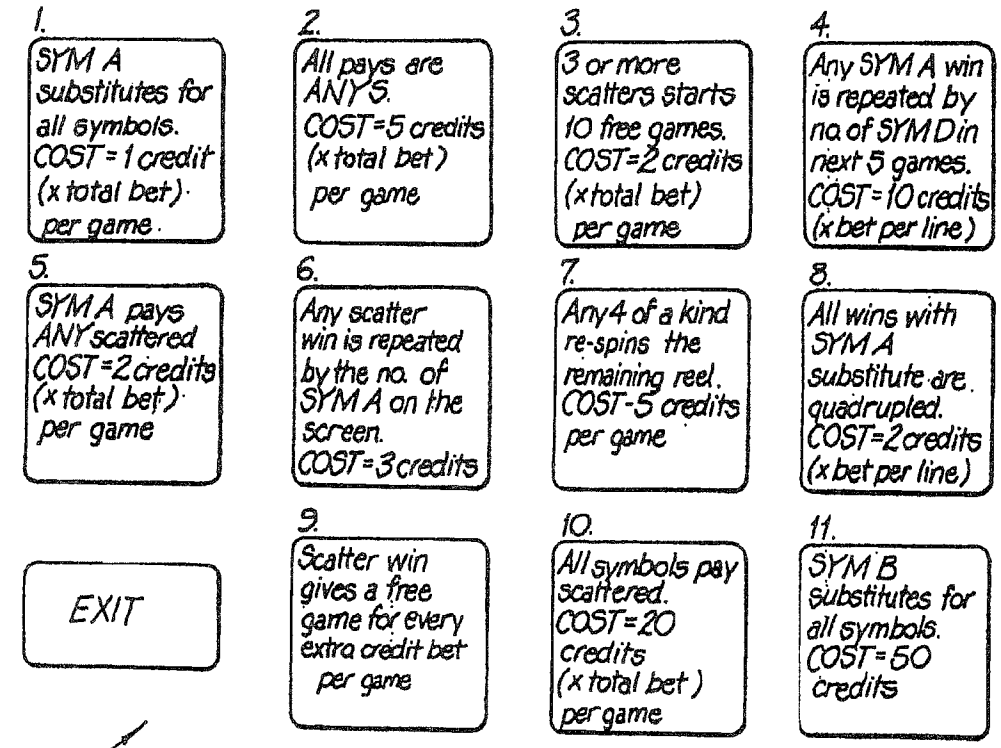
FIG. 6 shows a schematic representation of one embodiment of a third screen of the gaming machine.
Figure 7:
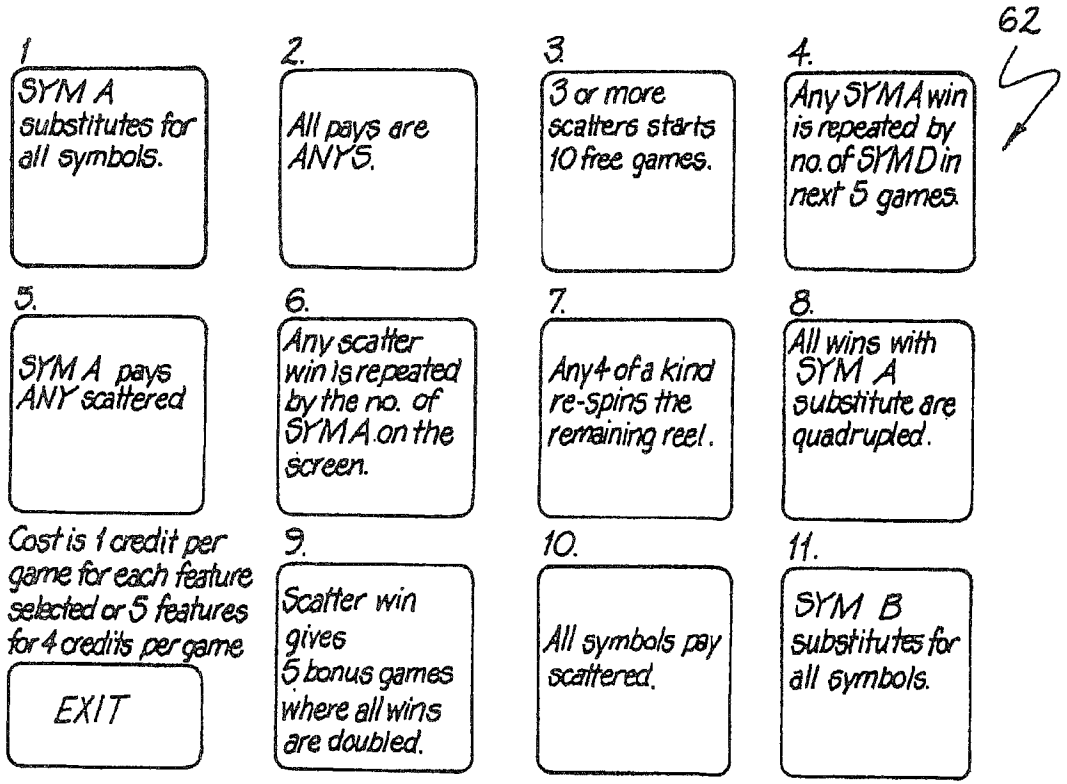
FIG. 7 shows a schematic representation of another embodiment of the third screen of the gaming machine.

To ensure versatility, the player may be given a choice of which features the player wishes to buy. Then, various icons are displayed on the screen as will now be described with reference to FIGS. 4 to 7 of the drawings. In FIG. 4, a basic game screen is shown and is designated generally by the reference numeral 50. The game screen has the usual reels 18 and multi-line pays as indicated by the arrows 52. If the player touches the icon "Prizes" as indicated at 54, a screen 56 shown in FIG. 5 of the drawings is displayed to show what prizes are available to the player. By touching the icon 58 entitled "Features" either a screen 60 as shown in FIG. 6 of the drawings or a screen 62, as shown in. FIG. 7 of the drawings is displayed. The screens 60 and 62 are similar with the difference between the screens being that, in the case of the screen illustrated in FIG. 7 of the drawings, the bet to be made by the player is independent of the type of feature altogether.

The screen in FIG. 6 or 7 allows the players to select the features required. The various icons illustrated as representations of the screens in FIGS. 6 and 7 are largely self explanatory. Suffice to say that a player can select various available options to construct their own games at a cost which that player can afford. The cost may be relative to an aspect of the base bet, i.e. the bet made for the basic game, or independent of the base bet. In addition, the player may be able to nominate the amount they wish to pay for eligibility to a particular feature.

In addition, in this embodiment, various features may be offered by the machine 10 such as, for example, certain combinations of a particular symbol triggering a bonus mode where for the next 10 games each symbol of another type that appears pays a bonus. As a further example, a bought feature could be that a particular symbol acts as a substitute symbol for all other symbols or pays for scattered combinations instead of just on a pay line. Hence, it will be appreciated that a large number of features could be built into the machine 10 to be offered to the players. By the player increasing his or her initial bet, eligibility to the feature is gained.

Figure 8:
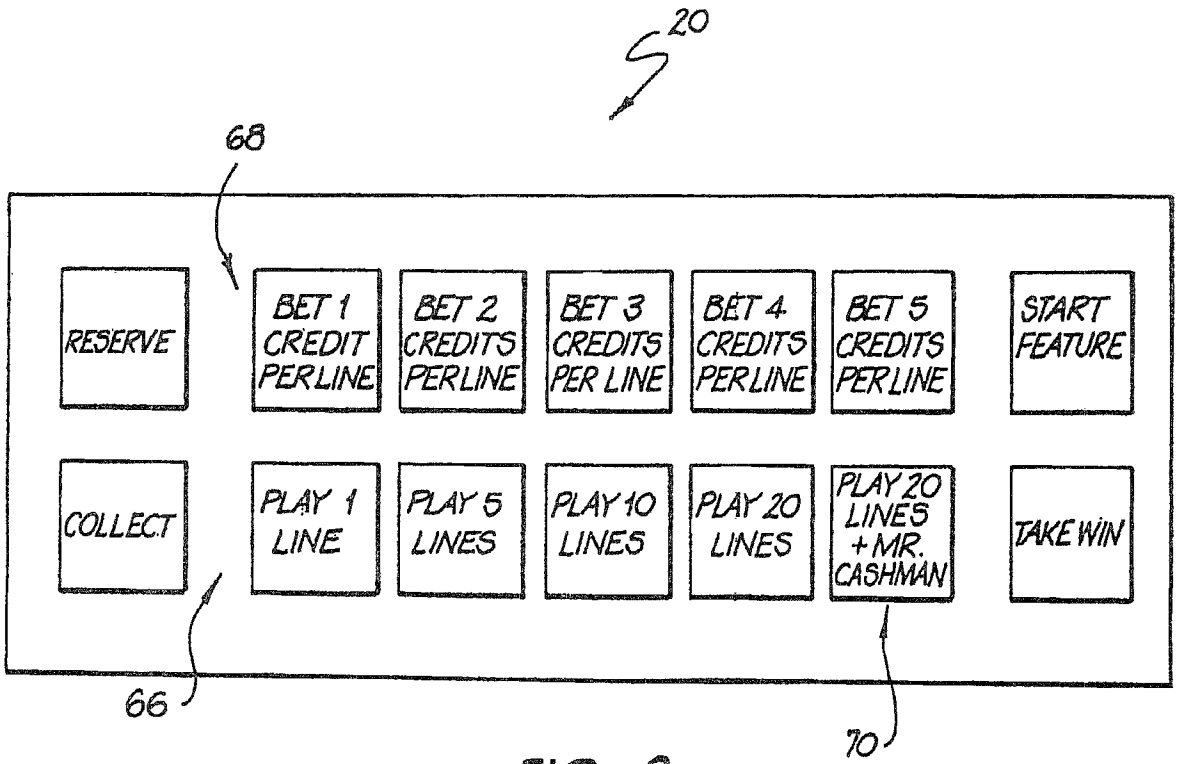
FIG. 8 shows a schematic plan representation of another embodiment of a keypad of the gaming machine.

Referring now to FIG. 8 of the drawings, a keypad 20 in accordance with another embodiment of the invention is illustrated. With reference to FIG. 3 of the drawings, like reference numerals refer to like parts, unless otherwise specified.

In this embodiment of the invention, instead of the buttons 64, a selection button 70 is provided.

Figure 9:
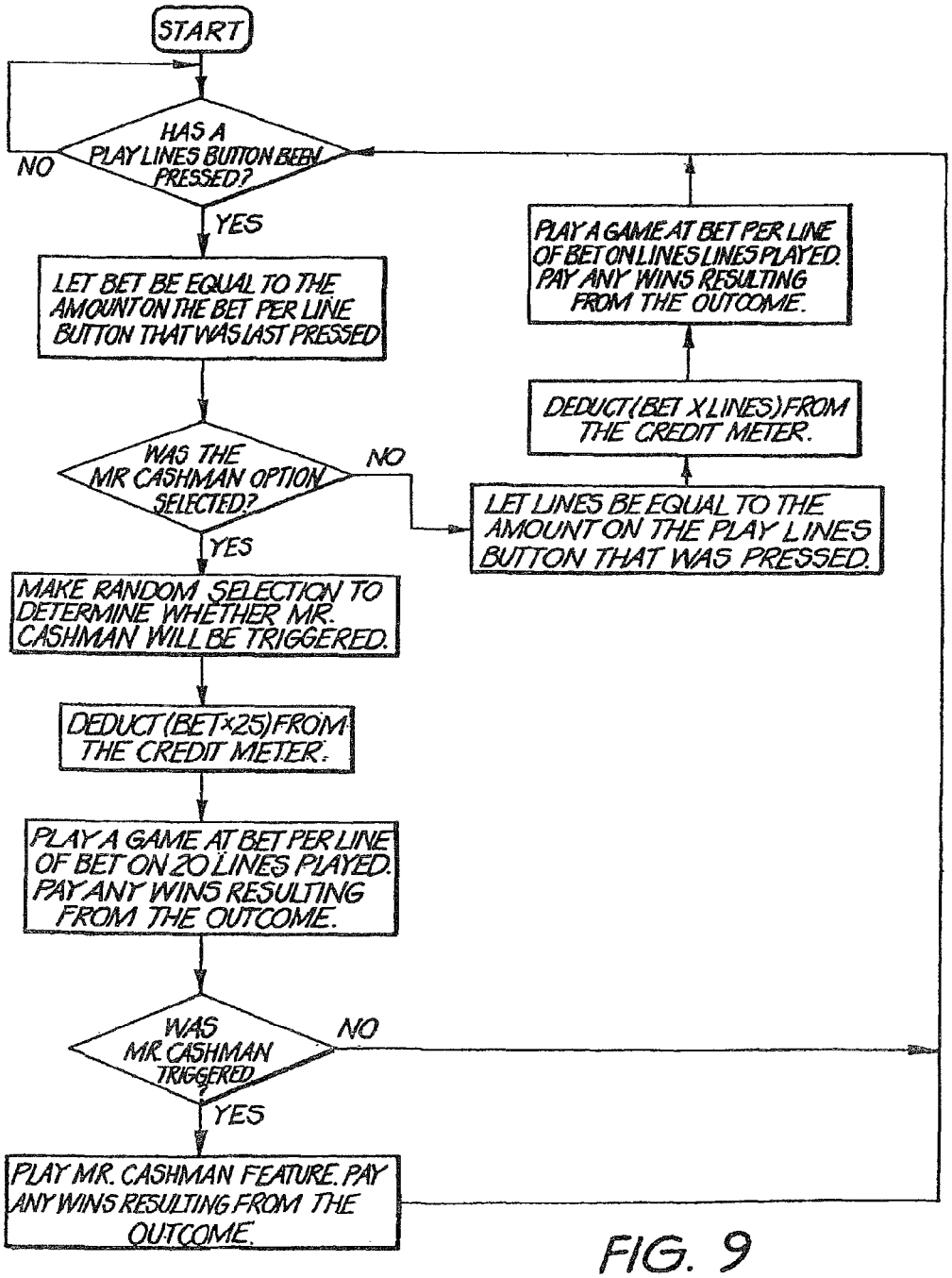
FIG. 9 shows a flow chart of the operation of the embodiment of the invention described with reference to FIG. 8.

In this embodiment of the invention, the player, as illustrated in FIG. 9, is required to make a special bet in order to be eligible for the feature. The feature, in this embodiment is the applicant's Mr Cashman. Mr Cashman is a trademark of the applicant and is described in detail in our co-pending PCT Application Number PCT/AU99/01059 dated 26 Nov. 1999 and entitled "Player information delivery". The contents of PCT/AU99/01059 are specifically incorporated herein by reference. The selection of the Mr Cashman feature is by way of the selection button 70. If the player chooses not to play the Mr Cashman feature, then bets are made in the standard way using the standard buttons 66 and 68.

The Mr Cashman feature is, as illustrated, restricted to the maximum number of lines available for the game configuration. Thus, in the example illustrated, the Mr Cashman feature is provided when the player selects that feature and also elects to play the maximum number of lines being 20 lines. By selecting the feature using the button 70, the player will be eligible to enter the Mr Cashman feature for that game.

The extra cost involved for eligibility to the Mr Cashman feature will be five credits multiplied by the number of credits bet per line. Hence, in the illustrated example, the player must stake 25 credits multiplied by the bet per line in order to be eligible for the Mr. Cashman feature. Once again, the mere wagering of the additional credit does not guarantee that the feature will occur but only that the player is eligible for the feature. The Mr. Cashman feature is not triggered by any trigger condition in the base game. Rather, a random selection is made by the controller 34 completely independently of the base game to determine whether the Mr. Cashman feature is to be triggered or not.

In other words, the player first makes a bet per line using the button 68 and then selects the number of lines to be played using buttons 66 or, where the player desires to include the Mr Cashman feature, the player activates the button 70.

Then, for each game played with the extra feature, the player will have a predetermined probability of triggering the Mr Cashman feature to commence after the base game has been completed.

Accordingly, by means of the invention a more versatile gaming machine 10 is provided which provides players with a greater number of options. In so doing, it is believed that the machines 10 will become more attractive to players.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming machine which includes:

a display that under the control of a game controller displays a plurality of display positions for displaying combinations of symbols;

the game controller controlling operation of the gaming machine, and displaying selected symbols on the display; and a selector operable by a player of the gaming machine to enable the player to select a feature which can be added to a base game played on the gaming machine, and to make a wager on the game, the wager including a base game component and an additional wager component, the additional wager component required by the game controller to be staked by the player in order for the player to be eligible for the feature, there being no guarantee that a benefit provided by the feature will eventuate merely by having staked the additional wager, wherein when the benefit eventuates, the size of the benefit provided by the feature is dependent on the wager on the game; and wherein the feature includes a series of free games and the number of free games provided by the feature is dependent on the size of the base game component of the wager.

2. The gaming machine of claim 1, wherein the size of the benefit provided by the feature is dependent on the base game component of the wager.

3. The gaming machine of claim 2, wherein the base game base is one in which a player stakes a wager on an outcome of the base game, and if a winning outcome occurs, the gaming machine awards that player a prize, and wherein the selector is further operable by the player to control the base game component of the wager by selecting both the size of the wager per outcome and the number of outcomes on which that wager is placed, wherein the size of the benefit provided by the feature is dependent on the size of the wager per outcome.

4. The gaming machine of claim 3, wherein the size of the additional wager is dependent on the size of the wager per outcome.

5. The gaming machine of claim 4, wherein the additional wager is the product of the size of the wager per outcome and a constant.

6. The gaming machine of claim 3, wherein the game controller only allows the additional wager component to be staked when a particular number of said outcomes is also selected.

7. The gaming machine of claim 6, wherein the particular number of said outcomes is the maximum possible number of outcomes on which the player can place a wager in the base game.

8. The gaming machine of claim 7, wherein the player has only one choice for the feature which can be added to the base game.

9. A gaming machine which includes:

a display that under the control of a game controller displays a plurality of display positions for displaying combinations of symbols;

the game controller controlling operation of the gaming machine, and displaying selected symbols on the display; and a selector operable by a player of the gaming machine to enable the player to select a feature which can be added to a base game played on the gaming machine, and to make a wager on the game, the wager including a base game component and an additional wager component, the additional wager component required by the game controller to be staked by the player in order for the player to be eligible for the feature, there being no guarantee that a benefit provided by the feature will eventuate merely by having staked the additional wager, wherein when the benefit eventuates, the size of the benefit provided by the feature is dependent on the wager on the game; and wherein the base game is a spinning reel game and the benefit provided by the feature includes a re-spin of one or more reels in the spinning reel game, wherein the number of re-spins provided is dependent on the size of the base game component of the wager.

10. The gaming machine of claim 9, wherein the size of the benefit provided by the feature is dependent on the base game component of the wager.

11. The gaming machine of claim 10, wherein the base game base is one in which a player stakes a wager on an outcome of the base game, and if a winning outcome occurs, the gaming machine awards that player a prize, and wherein the selector is further operable by the player to control the base game component of the wager by selecting both the size of the wager per outcome and the number of outcomes on which that wager is placed, wherein the size of the benefit provided by the feature is dependent on the size of the wager per outcome.

12. The gaming machine of claim 11, wherein the size of the additional wager is dependent on the size of the wager per outcome.

13. The gaming machine of claim 12, wherein the additional wager is the product of the size of the wager per outcome and a constant.

14. The gaming machine of claim 11, wherein the game controller only allows the additional wager component to be staked when a particular number of said outcomes is also selected.

15. The gaming machine of claim 14, wherein the particular number of said outcomes is the maximum possible number of outcomes on which the player can place a wager in the base game.

16. The gaming machine of claim 15, wherein the player has only one choice for the feature which can be added to the base game.

17. A gaming machine which includes:

a display that under the control of a game controller displays a plurality of display positions for displaying combinations of symbols;

the game controller controlling operation of the gaming machine, and displaying selected symbols on the display; and a selector operable by a player of the gaming machine to enable the player to select a feature which can be added to a base game played on the gaming machine, and to make a wager on the game, the wager including a base game component and an additional wager component, the additional wager component required by the game controller to be staked by the player in order for the player to be eligible for the feature, there being no guarantee that a benefit provided by the feature will eventuate merely by having staked the additional wager, wherein when the benefit eventuates, the size of the benefit provided by the feature is dependent on the wager on the game; and wherein the benefit provided by the feature is the availability of one of a substitute symbol and a scatter pays symbol to form a winning combination, there being at least two options for substitute or scatter pays symbols, with different symbols requiring different sized wagers.

18. The gaming machine of claim 17, wherein the size of the benefit provided by the feature is dependent on the base game component of the wager.

19. The gaming machine of claim 18, wherein the base game base is one in which a player stakes a wager on an outcome of the base game, and if a winning outcome occurs, the gaming machine awards that player a prize, and wherein the selector is further operable by the player to control the base game component of the wager by selecting both the size of the wager per outcome and the number of outcomes on which that wager is placed, wherein the size of the benefit provided by the feature is dependent on the size of the wager per outcome.

20. The gaming machine of claim 19, wherein the size of the additional wager is dependent on the size of the wager per outcome.

21. The gaming machine of claim 20, wherein the additional wager is the product of the size of the wager per outcome and a constant.

22. The gaming machine of claim 19, wherein the game controller only allows the additional wager component to be staked when a particular number of said outcomes is also selected.

23. The gaming machine of claim 22, wherein the particular number of said outcomes is the maximum possible number of outcomes on which the player can place a wager in the base game.

24. The gaming machine of claim 23, wherein the player has only one choice for the feature which can be added to the base game.

* * * * *